US010181703B2

(12) United States Patent
Liu

(10) Patent No.: US 10,181,703 B2
(45) Date of Patent: Jan. 15, 2019

(54) ELECTRODE FOR GENERATING NEGATIVE OXYGEN ION AND NEGATIVE OXYGEN ION GENERATOR USING THE ELECTRODE

(71) Applicant: Yanbing Liu, Jinan (CN)

(72) Inventor: Yanbing Liu, Jinan (CN)

( * ) Notice: Subject to any disclaimer, the term of this patent is extended or adjusted under 35 U.S.C. 154(b) by 562 days.

(21) Appl. No.: 14/972,044

(22) Filed: Dec. 16, 2015

(65) Prior Publication Data

US 2017/0063049 A1 Mar. 2, 2017

(30) Foreign Application Priority Data

Aug. 31, 2015 (CN) ..... 2015 1 0551143

(51) Int. Cl.
*H01T 19/04* (2006.01)
*H01T 23/00* (2006.01)

(52) U.S. Cl.
CPC ..... *H01T 23/00* (2013.01); *H01T 19/04* (2013.01)

(58) Field of Classification Search
CPC ..... H01T 23/00; H01L 2924/0002; H01L 2924/00
USPC ..... 361/231
See application file for complete search history.

(56) References Cited

U.S. PATENT DOCUMENTS

| | | | | |
|---|---|---|---|---|
| 3,504,227 | A * | 3/1970 | Mangold | H01T 23/00 361/231 |
| 8,009,405 | B2 * | 8/2011 | Gefter | H01T 23/00 361/213 |
| 9,706,628 | B2 * | 7/2017 | Feng | H01T 19/04 |
| 2006/0152881 | A1 * | 7/2006 | Hou | H01T 23/00 361/231 |
| 2016/0221002 | A1 * | 8/2016 | Lin | F24F 3/16 |

* cited by examiner

*Primary Examiner* — Dharti H Patel

(57) ABSTRACT

The invention discloses electrode for generating negative oxygen ion and negative oxygen ion generator using the electrode, comprising a wire loop with a longitudinal section shaped U, a circle of fibre bundle filled inside of the U-shaped groove in the wire loop, wherein the fibre bundle and wire loop are tightly glued by conducting resin and the said wire loop is composed of micrometer-size carbon fiber or fullerene fiber. The invention improves the productivity of negative oxygen ions and greatly reduces the generation of Ozone molecules. Besides, by utilizing the strong turning air flow to transfer the generated negative oxygen ions in high concentration to the space of a long distance for human to breathe, it improves the use efficiency of negative oxygen ions without the filter net, simplifies the structure of negative oxygen ion generator in this invention, as well as decreases its size.

2 Claims, 2 Drawing Sheets

2--2

1--2

2--2

ELECTRODE FOR GENERATING NEGATIVE OXYGEN ION AND NEGATIVE OXYGEN ION GENERATOR USING THE ELECTRODE

BACKGROUND OF THE INVENTION

The invention involves electrode for generating negative oxygen ion and negative oxygen ion generator using the electrode.

At present, the negative oxygen ion generator often directly uses the columnar or acicular metal needle as the electrode for generating negative oxygen ion. The productivity of negative oxygen ion and level of generated Ozone molecules depend on the voltage applied to the metal electrode. The exorbitant negative high voltage is conductive for the generation of negative oxygen ions and Ozone molecules, which may cause the intoxication in human body. Again, due to the easily oxidized on the tip of metal needle, it may lose the tip discharge process. To reduce the productivity of Ozone molecules, at present, many negative oxygen ion generators wrap tens of thousands of or hundreds of thousands of carbon fiber or fullerene fiber as the emitting electrode on surfaces of each wire loop or acicular metal electrode. This kind of emitting electrode could reduce the ozone produce efficiency to some extent, but due to the structure, the number of fixed carbon fiber or fullerene fiber is very limited. If there were too many carbon or fullerene fibers fixed on each wire loop or acicular metal electrode, then carbon or fullerene fibers that far away from the wire loop or needle cannot obtain sufficiently high intensity of negative high voltage electric field. In this case, these carbon or fullerene fibers would not emit electrons and generate no negative oxygen ion, showing a lower productivity of negative oxygen ions. The surface area of the existing carbon fiber or fullerene fiber bundle fixed on each wire loop or needle is small, which leads to the relatively low capacity for adsorbing electropositive Ozone molecules. Due to the high concentration of Ozone molecules, the instrument still needs the filter net for Ozone molecules. Besides, this kind of wire loop or acicular metal electrode whose surface is wrapped of carbon or fullerene fibers cannot utilize the strong air flow to transmit the generated negative oxygen ions to the space that lies beyond.

The negative oxygen ions generated by the existing negative oxygen ion generator are easily recombined by the particles of all kinds in the air (such as the dust and bacterial molecule, etc.) at the instrument outlet. Due to the short conveying distance, the negative oxygen ions in the space far away from instrument outlet are not much left. Therefore, negative oxygen ions are difficult to be conveyed to further space for human to breathe and play a little role in human's health. At the same time, Ozone molecules that cannot be conveyed to further space would achieve a higher concentration, which is extremely unfavorable for the human health. To reduce the concentration of Ozone molecules generated by the negative oxygen ion generator, the filter net is usually added at the outlet of negative oxygen ions. Adding the filter net possesses certain effects on restraining the concentration of Ozone molecules, but it greatly reduces the concentration and conveying distance of negative oxygen ions.

BRIEF SUMMARY OF THE INVENTION

In view of deficiencies present in the prior art, the purpose of the present invention is to provide an electrode for generating negative oxygen ion. For rational structural design, it increases the productivity of negative oxygen ions, greatly reduces the generation of Ozone molecules, conveys negative oxygen ions of high concentration to a remote space for human to breathe by strong air flow, enhances the use efficiency of negative oxygen ions without the filter net, simplifies the structure of negative oxygen ion generator in this invention, decreases its size, as well as solves the deficiencies present in the prior art.

To solve the above technical problems, the technical plan adopted in this invention is:

an electrode for generating negative oxygen ion comprises a wire loop with a longitudinal section shaped U, a circle of fiber bundle filled inside of the U-shaped groove in the wire loop, wherein the fiber bundle and wire loop are tightly glued by conducting resin and the said wire loop is composed of micrometer-size carbon fiber or fullerene fiber.

A negative oxygen ion generator using an electrode used for an electrode for generating negative oxygen ion as stated above comprises a wind tunnel body and the shell covered outside it, wherein one side is air inlet, and the other side is reducing air outlet. An air reducing opening used for an electrode generating oxygen anion is set inside of the wind tunnel body, which is between the air inlet and the reducing air outlet, an electrode for generating negative oxygen ion is set in the middle of the air reducing outlet by erection fixture, and an inlet fan is set at the air inlet. It smoothly declines in succession from the air inlet to the inside radius of the wind tunnel body of the air reducing outlet, due to the inside radius of the air reducing outlet is similar to that of the air inlet, so it smoothly increases in succession from the air reducing outlet to the inside radius of the wind tunnel body of the air reducing outlet. The negative high voltage power source is set outside of the shell and the wire loop used for an electrode for generating negative oxygen ion is connected to the negative high voltage power source by the conductor.

Several rifle helical grooves with the same direction of turning on the wall inside of the wind tunnel body, which is between the air reducing opening and the air inlet.

Adopting the above structure in the invention satisfies a rational structural design. It enlarges the curvature (stridency) of the emitting electrode tip by adopting the micrometer-size carbon fiber or fullerene fiber, strengths the field intensity of tip areas and improves the productivity of negative oxygen ions due to the easier generation of negative oxygen ions in stronger tip areas. The fiber bundles are into a circle pattern, each carbon fiber can emit electrons under negative pressure, and due to the invention's emission electrode structure, the number of carbon fibers that can be fixed is greatly larger than that based on wire loop or needle. In this way, it increases the capability of electrons emission and improves the productivity of negative oxygen ions. Again, the round fiber bundles have also enlarged the distribution area of the negative high voltage electric field, wherein the larger the distribution area of the negative high voltage electric field is, the greater absorbing capacity of Ozone molecules and other harmful molecules would be. The relatively large surface area of electrode comprised by wire loops and round fiber bundles may improve the capacity for forming negative oxygen ions from the Ozone molecules by one time or several times, further improve the productivity of negative oxygen ions and restrict the generation of Ozone molecules more effectively to enable negative oxygen ion generator go without the installation of filter net. In this way, the structure is thus simplified and the volume is reduced. The middle part of this utilization model is pin-through-hole by metal circles, which could reduce the kinetic energy for emission of electrons by the strong air flow of electrode economizer and thus more effectively inhibit the ozone molecules and convey the negative oxygen ions to the further space. The invention, an negative oxygen ion generator, uses the strong high-speed turning rotating air flow generated by wind tunnel effect and ballistic effect to convey negative oxygen ions generated by the electrode to remote space for human to breathe and thus for effective utilization by human.

In the figures: 1. wire loop; 2. U-shaped groove; 3. fiber bundle; 4. wind tunnel body; 5. Shell; 6. air inlet; 7. reducing air outlet; 8. air reducing opening; 9. inlet fan; 10. negative high voltage power source; 11. rifle helical groove

DETAILED DESCRIPTION OF THE INVENTION

Detailed description with reference to the technical features of this invention is given by specific embodiments as below.

Figure 1:
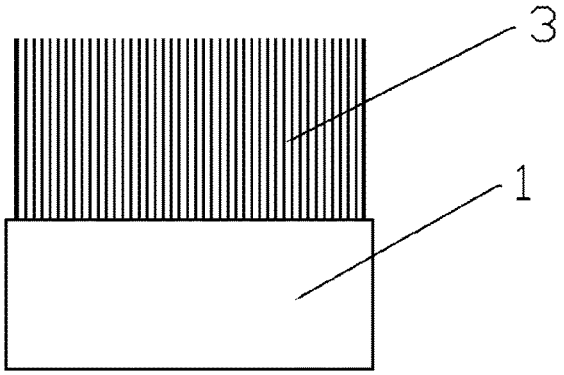
FIG. 1 is a structural representation for the invention: an electrode for generating negative oxygen ion.
Figure 2:
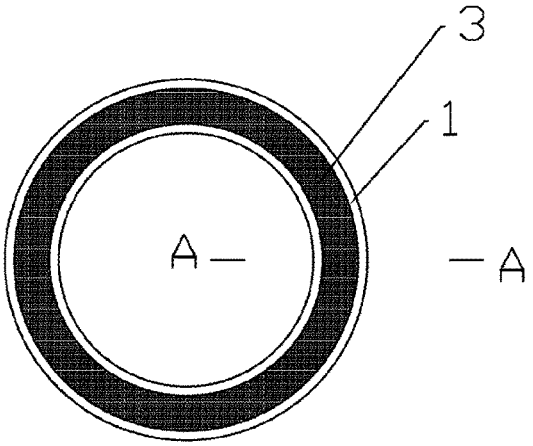
FIG. 2 is a downward structural representation for FIG. 1.
Figure 3:
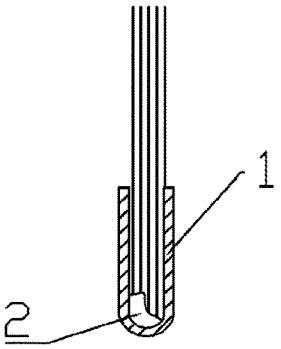
FIG. 3 is the cross-section structural representation for A-A.

As shown in FIG. 1-3, an electrode for generating negative oxygen ion comprises a wire loop 1 with a longitudinal section shaped U, a circle of fiber bundle 3 filled inside of the U-shaped groove 2 in the wire loop 1, wherein the fiber bundle 3 and wire loop 1 are tightly glued by conducting resin and the said wire loop 3 is composed of micrometer-size carbon fiber or fullerene fiber.

Figure 4:
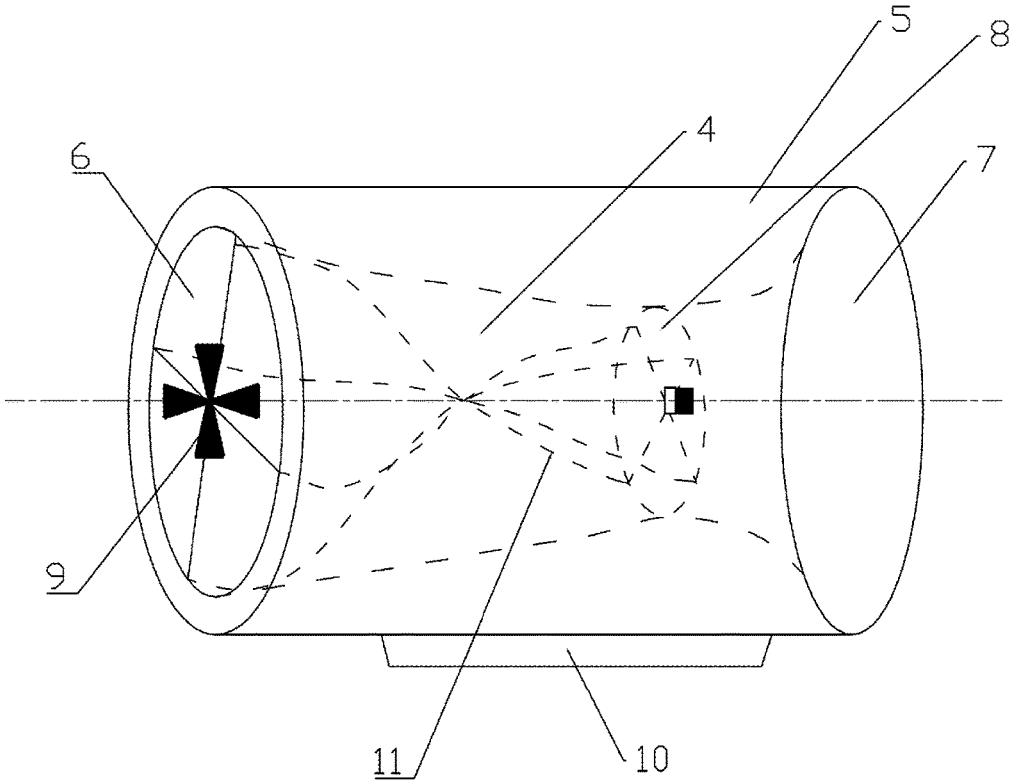
FIG. 4 is the structural representation for the invention: a negative oxygen ion generator.

As shown in FIG. 4, a negative oxygen ion generator using an electrode for generating negative oxygen ion as stated above comprises a wind tunnel body 4 and the shell 5 covered outside it 4, wherein one side is air inlet 6, and the other side 7 is reducing air outlet. An air reducing opening 8 used for electrode generating oxygen anion is set inside of the wind tunnel body 1, which is between the air inlet 6 and reducing air outlet 7, an electrode for generating negative oxygen ion is set in the middle of the air reducing outlet 8 by erection fixture, and an inlet fan 9 is set at the air inlet 6. It smoothly declines in succession from the air inlet 6 to the inside radius of the wind tunnel body 1 of the air reducing outlet 8, due to the inside radius of the air reducing outlet 7 is similar to that of the air inlet 6, so it smoothly increases in succession from the air reducing outlet 8 to the inside radius of the wind tunnel body 1 of the air reducing outlet 7. The negative high voltage power source 10 is set outside of the shell 5 and the wire loop 1 used for an electrode generating oxygen anions is connected to the negative high voltage power source 10 by the conductor.

When using the utilization model negative oxygen ion generator, please start the inlet fan 9 to energize the electrode for generating negative oxygen ion. The wind tunnel body 4 utilizing the change of radius can change the air flow direction and the feature accelerating flow rate, in other words, it uses the wind tunnel effect to generate strong turning air flow inside of wind tunnel body 4 and conveys negative oxygen ions generated by the electrode to remote space for human to breathe. The electrode for generating negative oxygen ion can be detachably installed on the bracket by the base, so in case of damage, it can be removed together with the base.

Several rifle helical grooves 11 with the same direction of turning on the wall inside of the wind tunnel body 4, which is between the air reducing opening 8 and the air inlet 6. By setting the rifle helical grooves 11 inside of the wind tunnel body in accordance with regular change of the radius, the wind tunnel effect and ballistic effect are combined together, and thus generate strong turning air flow. Compared with those only using the wind tunnel body, it can convey the generated negative oxygen ions to further space for human to breathe.

This invention is not limited to the specific embodiments stated above, so those technicians in the art can make various modifications and improvements within a scope of claims and without any influence on essential contents of the invention.

Those not detailed with reference to the utilization model are prior arts of technicians in the art.

What is claimed is:

1. A negative oxygen ion generator using an electrode for generating negative oxygen ion, wherein, the electrode for generating negative oxygen ion comprises:

a wire loop having a U shaped longitudinal section; and a circular fiber bundle filled inside a U shaped groove of the wire loop, wherein the fiber bundle and the wire loop are tightly glued by conducting resin, and the wire loop is made of micrometer-size carbon fibers or fullerene fibers;

the negative oxygen ion generator comprises:

a wind tunnel body;

a shell covering an outer side of the wind tunnel body;

an air inlet at one side of the wind tunnel body;

a reducing air outlet at another side of the wind tunnel body;

an air reducing opening provided inside the wind tunnel body at a position between the air inlet and the reducing air outlet;

an inlet fan provided at the air inlet;

a negative high voltage power source provided outside the shell, wherein the wire loop is connected to the negative high voltage power source by a conductor; and the electrode for generating negative oxygen ion fixed in the middle of and perpendicular to the air reducing opening;

the wind tunnel body reduces a diameter thereof smoothly and gradually from the air inlet towards the air reducing opening, and since a diameter of the air reducing outlet is similar to a diameter of the air inlet, the wind tunnel body increases the diameter thereof smoothly and gradually from the air reducing opening towards the air reducing outlet.

2. The negative oxygen ion generator of claim 1, wherein several rifle helical grooves with the same turning direction are provided on an inner wall of the wind tunnel body between the air reducing opening and the air inlet.

* * * * *